US008985021B2

(12) United States Patent
Schnabel et al.

(10) Patent No.: US 8,985,021 B2
(45) Date of Patent: Mar. 24, 2015

(54) METHOD OF SETTING WEB TENSIONING

(75) Inventors: Holger Schnabel, Veitshoechheim (DE); Stephan Schultze, Lohr-Wombach (DE); Mario Goeb, Wuerzburg (DE)

(73) Assignee: Robert Bosch GmbH, Stuttgart (DE)

( * ) Notice: Subject to any disclaimer, the term of this patent is extended or adjusted under 35 U.S.C. 154(b) by 992 days.

(21) Appl. No.: 13/127,943

(22) PCT Filed: Sep. 1, 2009

(86) PCT No.: PCT/EP2009/006310

§ 371 (c)(1),
(2), (4) Date: Jul. 21, 2011

(87) PCT Pub. No.: WO2010/051874

PCT Pub. Date: May 14, 2010

(65) Prior Publication Data

US 2012/0048984 A1 Mar. 1, 2012

(30) Foreign Application Priority Data

Nov. 6, 2008 (DE) ..... 10 2008 056 132

(51) Int. Cl.
*B65H 23/188* (2006.01)

(52) U.S. Cl.
CPC ..... *B65H 23/188* (2013.01); *B65H 23/1888* (2013.01); *B65H 2557/2644* (2013.01); *Y10S 101/42* (2013.01)
USPC .... 101/484; 101/228; 101/232; 101/DIG. 42; 242/419.5; 226/2; 226/28

(58) Field of Classification Search
CPC ..... B65H 23/192; B65H 23/1882; B65H 23/1888; B65H 2515/31
USPC ..... 101/484
See application file for complete search history.

(56) References Cited

U.S. PATENT DOCUMENTS 4,847,775 A * 7/1989 Roch et al. ..... 700/125
5,117,753 A * 6/1992 Mamberer ..... 101/225

(Continued)

FOREIGN PATENT DOCUMENTS

| | | |
|---|---|---|
| DE | 10335885 | 3/2005 |
| DE | 10335887 | 3/2005 |
| DE | 102007017095 | 10/2008 |
| EP | 1505025 | 2/2005 |
| EP | 1795470 | 6/2007 |
| WO | 0207974 | 1/2002 |

OTHER PUBLICATIONS

Lee, Bong-Ju, et al.: Analysis of a Nonlinear Web-Tension Control System of a High-Speed Gravure Printing Machine. SICEICASE International Joint Conference, 2006, Oct. 21, 2006 Fig 8 (6 pages).

(Continued)

*Primary Examiner* — Jill Culler
(74) *Attorney, Agent, or Firm* — Maginot, Moore & Beck LLP

(57) ABSTRACT

A method of setting web tensioning in a processing machine for processing a material web, in particular in a shaftless printing machine, wherein, for the purpose of setting the web tensioning in a first web-tensioning portion, which is bounded upstream by a first clamping location and downstream by a second clamping location, the first clamping location is given a control command, and at least one clamping location which is located upstream of the first clamping location, as seen over the course of the web tensioning, and at least one clamping location which is located downstream of the second clamping location, as seen over the course of the web tensioning, are precontrolled in dependence on the first control command, where the second clamping location is not adjusted.

17 Claims, 2 Drawing Sheets

(56) References Cited

U.S. PATENT DOCUMENTS

| | | | | |
|---|---|---|---|---|
| 5,937,756 | A * | 8/1999 | Kishine et al. | 101/228 |
| 6,092,466 | A * | 7/2000 | Koch et al. | 101/485 |
| 6,427,590 | B1 * | 8/2002 | Rossler et al. | 101/181 |
| 6,546,871 | B1 * | 4/2003 | Glockner | 101/484 |
| 6,766,737 | B2 * | 7/2004 | Glockner et al. | 101/228 |
| 6,782,818 | B2 * | 8/2004 | Glockner et al. | 101/228 |
| 7,040,231 | B2 * | 5/2006 | Schaede | 101/484 |
| 7,137,338 | B2 * | 11/2006 | Brandenburg et al. | 101/484 |
| 7,185,587 | B2 * | 3/2007 | Brandenburg et al. | 101/484 |

OTHER PUBLICATIONS

International Search Report/Opinion corresponding to PCT Application No. PCT/EP2009/006310, mailed Nov. 25, 2009 (German and English language document) (15 pages).

Search Report of the German Patent and Trademark Office corresponding to German Patent Application No. DE 10 2008 056 132.0 dated Oct. 2, 2009 (4 pages).

* cited by examiner

METHOD OF SETTING WEB TENSIONING

This application is a 35 U.S.C. §371 National Stage Application of PCT/EP2009/006310, filed Sep. 1, 2009, which claims the benefit of priority to Serial No. DE 10 2008 056 132.0, filed Nov. 6, 2008 in Germany, the disclosures of which are incorporated herein by reference in their entirety.

BACKGROUND

The present disclosure relates to a method of setting web tensioning in a processing machine, to a processing machine, to a corresponding computer program and to a corresponding computer program product.

Although reference will be made hereinbelow predominantly to printing machines, the disclosure, rather than being limited to this field, is directed to all types of processing machine in which a material web is processed. However, the disclosure can be used in particular in printing machines, e.g. newspaper-printing machines, commercial printing machines, gravure printing machines, inline flexographic printing machines, packaging printing machines or security printing machines, and in processing machines, e.g. bag machines, envelope machines or packaging machines. The material web may be formed from paper, fabric, cardboard, plastics material, metal, rubber, film or sheet material, etc.

In processing machines, in particular printing machines, a material web is moved along driven axes (web-transporting axes) e.g. pulling rollers or advancement rollers, and non-driven axes, e.g. deflecting, directing, drying or cooling rollers. The material web is simultaneously processed, for example printed, punched, cut, folded, etc., by means of usually likewise driven processing axes.

The tensioning of the material web is influenced, for example, via so-called clamping locations, by means of which the material web is clamped in with a friction fit, form fit or force fit. These clamping locations are usually driven transporting or processing units. In the case of a gravure printing machine, a clamping location is customarily formed by a printing unit in which there is a friction fit between the driven impression cylinder, the pressing roller and the material web. The material web is subdivided into web-tensioning portions, wherein a web-tensioning portion is bounded by two clamping locations. Further driven and/or non-driven axes may be arranged within a web-tensioning portion. It is often the case that the entire material web is subdivided into a plurality of web-tensioning portions, in some cases also one with different desired web-tensioning values. For the purpose of maintaining the desired values, use is usually made of web-tensioning regulation.

DE 103 35 885 A1 discloses combined register and web-tensioning regulation. An upstream strategy for the web-tensioning regulation is proposed for the purpose of isolating the register and web-tensioning setting operation. In this case, however, the web-tensioning of the downstream web-tensioning portions is not isolated from the setting operations.

Likewise known downstream strategies, which would make it possible for downstream web-tensioning portions to be isolated, require the activation of the downstream clamping location of the web-tensioning portion. However, if this clamping location cannot be set, it is not possible for isolated web-tensioning setting or regulation to take place.

It is therefore an object of the disclosure to specify an improved method of setting web-tensioning which also allows for clamping locations which cannot be set.

This object is achieved by a method of setting web-tensioning, by a processing machine, by a computer program and by a computer program product, having the features of the independent patent claims. Advantageous developments form the subject matter of the dependent claims and of the following description.

SUMMARY

The solution according to the disclosure can provide for web-tensioning regulation which, by a combination of upstream and downstream strategies, can be adapted in a flexible manner to the given conditions of the machine in question. In particular it is possible for web-tensioning portions of which the downstream clamping location cannot be adjusted to be influenced in isolation. The prior art does not disclose any regulating strategies which would allow isolation of the web-tensioning setting operation beyond non-adjustable clamping location.

In the case of a downstream strategy, the clamping location which bounds the web-tensioning portion downstream is adjusted. At least one downstream clamping location can be adjusted dynamically or statically with account being taken of different timing elements and/or amplitudes. In the case of an upstream strategy, the relevant clamping location is not adjusted. At least one upstream clamping location is adjusted statically or dynamically with account being taken of different timing elements and/or amplitudes.

By means of the solution according to the disclosure, i.e. the precontrol of upstream and downstream clamping locations, the correction of a deviation in web tensioning is largely isolated. In the preferred case where all other clamping locations are precontrolled, there is a change only in the web tensioning in the web-tensioning portion which is to be corrected, without the downstream or upstream portions being effected. Consequently, the waste is significantly reduced and the processing accuracy is increased.

Of course, in addition to the setting of the web tensioning, the disclosure likewise covers the setting of a tensile force or of elongation, these likewise leading directly to a change in tensioning.

Web-tensioning regulation is advantageously carried out. Of course, a person skilled in the art can use the setting operation according to the disclosure as part of a regulating operation.

The precontrol is advantageously carried out with different amplitudes, for example with weighting, and/or different time responses. For example, the control commands for the clamping locations which are adjacent to the non-adjusted clamping location may have a greater amplitude and/or the variation of the control commands over time may exhibit a different, in particular greater, rise or fall than for clamping locations which are further remote.

In a further configuration, the at least one clamping location which is located upstream of the first clamping location, as seen over the course of the web tensioning, and/or the at least one clamping location which is located downstream of the second clamping location, as seen over the course of the web tensioning, are precontrolled statically and/or dynamically in dependence on the first control command. The precontrol method, i.e. static or dynamic, can be selected, and set, separately, on the basis of the given conditions, for each clamping location which is to be precontrolled.

The upstream precontrol may comprise, for example, a static action, for example a purely proportional action. For the downstream precontrol, it is recommended to have, in particular, a dynamic proportional, integral or time-delay element or a differential action. "Dynamic/dynamically" is intended to be understood hereinbelow as an action which changes over time, and in which the output variable, even with the input variable constant, varies over time, for example proportional elements with time delay PT1, PT2, PTn, differential elements DT1, DT2, DTn, integral elements IT1, ITn, dead-time elements or any desired combinations thereof.

The dynamic-coupling parameters, in particular the time constants, can be adapted in relation to the printing-machine speed, preferably in proportion to the reciprocal printing-machine speed. In addition, it is expedient for the dynamic-coupling parameter to be adapted to the material-web length. It is possible here for the dynamic-coupling parameters to be adapted, in particular, in proportion to the material-web length and/or material-web width. The coupling parameters may also be adapted to the type of printing material (modulus of elasticity). The parameters and the timing elements may be adapted by means of fuzzy techniques, model-based techniques, e.g. model-based regulation, observer techniques or Kalman techniques.

Dynamic timing elements can advantageously be adapted automatically, in particular to the web speed and/or the length. For this reason, it is expedient, in one configuration of the disclosure, for the web speed and/or the lengths between printing units to be measured automatically and for the corresponding time constants of the timing elements to be adapted, in which case the dynamic timing elements are not falsified by changes in speed and/or length. This makes it possible, inter alia, for automatic speed and/or length adaptation and, as a result, automatic adaptation of the dynamic timing elements to be carried out. length adaptation and, as a result, automatic adaptation of the dynamic timing elements to be carried out.

It is advantageous for all the clamping locations which are arranged upstream of the first clamping location, as seen over the course of the web tensioning, and are designed as processing devices, to be precontrolled statically in dependence on the first control command. As an option, it is also possible for clamping locations which are not designed as processing devices, e.g. infeed unit, unwinder, etc., to be precontrolled.

In another configuration, it is possible for all the clamping locations which are arranged downstream of the second clamping location, as seen over the course of the web tensioning, and are designed as processing devices, to be precontrolled dynamically in dependence on the first control command. As an option, it is also possible for clamping locations which are not designed as processing devices, e.g. discharge unit, winding-up unit, etc., to be precontrolled.

The upstream and downstream precontrol is expediently carried out here only as far as the final clamping location which will be influenced by the web-tensioning setting operation. In printing machines for example, it is known to have different subassemblies, e.g. cooling or drying devices, which in certain cases, on account of the material being influenced, isolates web tensioning, in which case a change in web tensioning does not continue beyond the subassemblies. Web-tensioning portions with such subassemblies are referred to, in these cases, as having "self-compensating" or "isolating" action. According to an expedient configuration, it is thus only the clamping locations of non-self-compensating web-tensioning portions which are precontrolled. In other words, the precontrol takes place, starting from the web-tensioning portion affected, upstream and/or downstream as far as the next self-compensating web-tensioning portion in each case.

In the case of a preferred configuration, the web-tensioning in the web-tensioning portions is determined by means of measuring elements, preferably load cells, by means of the driving torque of a clamping location which bounds this web-tensioning portion and/or by means of observers (regulated technology).

The web tensioning in a web-tensioning portion is expediently set by means of angular adjustment, rate feedback and/or limitation of the driving torque of at least one clamping location which bounds this web-tensioning portion.

A computing unit according to the disclosure is designed, in particular in program terms, to implement a method according to the disclosure using a processing machine.

The disclosure additionally relates to a computer program with program code means for carrying out all the steps according to a method according to the disclosure if the computer program is run on a computer or a corresponding computing unit.

The computer program product which is provided according to the disclosure and has program code means which are stored in a computer-readable data carrier is designed for carrying out all the steps according to a method according to the disclosure if the computer program is run on a computer or a corresponding computing unit. Suitable data carriers are, in particular, floppy disks, hard disks, flash memories, EEPROMs, CD ROMs, DVDs, and the like. It is also possible to download a program via computer networks (Internet, intranet, etc.).

Further advantages and configurations of the disclosure can be gathered from the description and the accompanying drawing.

Of course, the features which have been mentioned above, and those which are yet to be explained hereinbelow, can be used not just in the given combination, but also in other combinations, or in their own right, without departing from the context of the present disclosure.

The disclosure is illustrated schematically, by way of exemplary embodiments, in the drawing and will be described in detail hereinbelow with reference to the drawing.

BRIEF DISCRIPTION OF THE DRAWINGS

DETAILED DESCRIPTION

Figure 1:
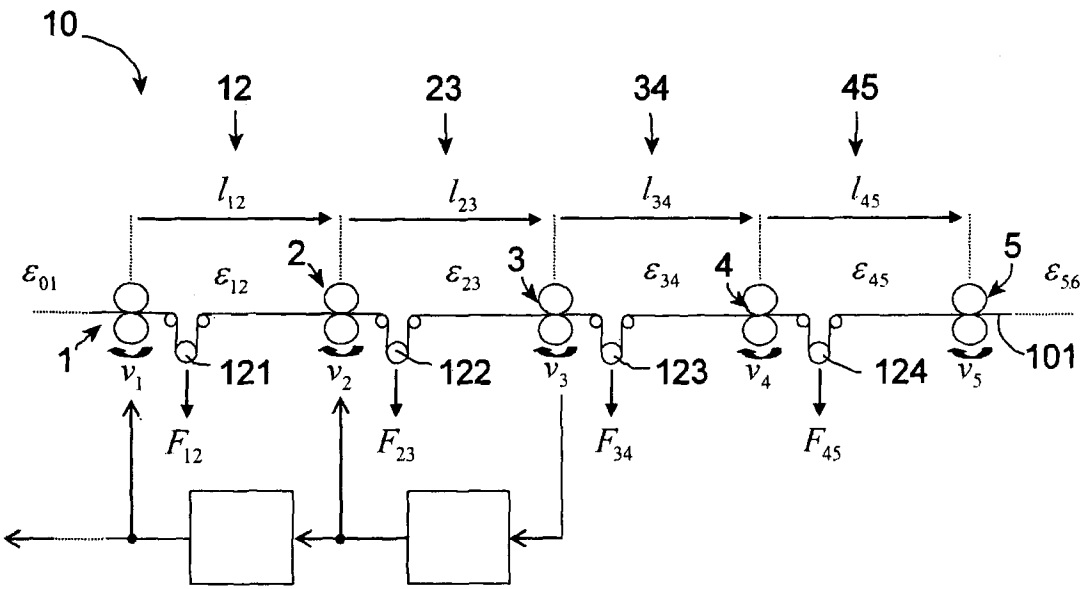
Fig. 1 Prior Art
FIG. 1 shows a schematic illustration of an example of a common upstream strategy for a deviation in web tensioning in a web-tensioning portion.

FIG. 1 is used to describe a known upstream regulating strategy using the example of web-tensioning regulation in a printing machine. It illustrates a schematic detail of a printing machine 10 in which a material web 101 is transported through, and processed by, five clamping locations, in this case designed as printing units 1 to 5. A web-tensioning portion is formed between in each case two adjacent clamping locations. For example, a web-tensioning portion 12 is bounded by the printing units 1 and 2, a web-tensioning portion 23 is bounded by the printing units 2 and 3, a web-tensioning portion 34 is bounded by the printing units 3 and 4 and a web-tensioning portion 45 is bounded by the printing units 4 and 5. The printing machine also has web-tensioning sensors, in this case designed as load cells 121 to 124, for the purpose of determining the web tensioning and/or the tensile force in the respective web-tensioning portions. In the illustration shown, the web tensioning is set via the circumferential speeds $v_1$ to $v_5$ of the printing units 1 to 5.

The physical parameters, namely the length l, the elongation ϵ and the web tensioning and/or tensile force F of the individual web-tensioning portions are likewise indicated in the figure.

For the purpose of setting the web tensioning in a web-tensioning portion 34, in the case of the upstream strategy illustrated, the printing units 1 to 3 are adjusted, as a result of which the web tensioning in the web-tensioning portions 12 and 23 can be isolated from the change in the web-tensioning portion 34. However, it is not possible in the case of the known solution for the web tensioning in the web-tensioning portion 45 also to be isolated from the change in the web-tensioning portion 34.

Figure 2:
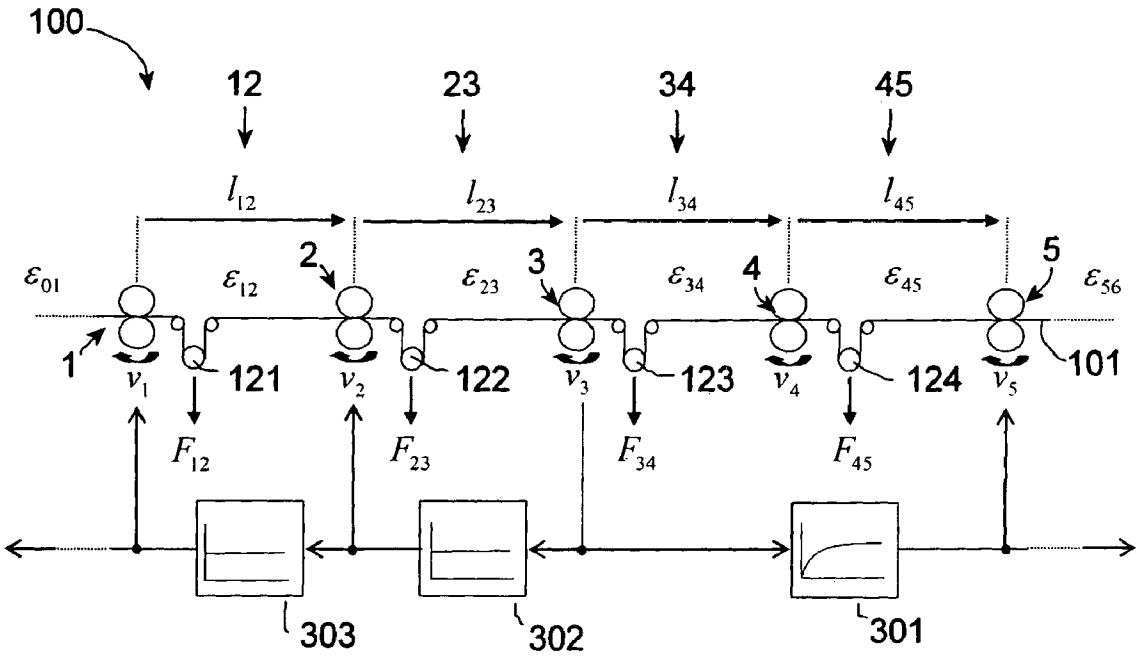
FIG. 2 shows a schematic illustration of an example of a regulating strategy according to the disclosure for a deviation in web tensioning in a web-tensioning portion.

FIG. 2 will be used to explain hereinbelow how the solution according to the disclosure can isolate the downstream web-tensioning portions. The same elements here are provided with the same designations. FIG. 2 shows a printing machine 100 which is regulated in accordance with the exemplary configuration.

For the purpose of isolating the web tensioning in the web-tensioning portion 45 from a change in the web-tensioning portion 34, a dynamic precontrol of the printing unit 5 is carried out according to the preferred embodiment of the disclosure illustrated. The dynamic precontrol takes place, for example, via a PT1 element 301, where a proportional gain P=1 and a time constant $T=1_{34}/v$ are selected. v represents the web speed. If the printing unit 5 is followed by further clamping locations (not illustrated in the figure), the precontrol is continued downstream expediently as far as the next self-compensating or isolating web-tensioning portion. The precontrol of further clamping locations takes place preferably likewise dynamically via a PT1 element with the same parameters P=1 and $T=1_{34}/v$. Of course, the precontrol can also take place using other elements e.g. PTn, DTn, ITn, dead-time elements, etc., or any desired combination thereof.

The upstream precontrol of the printing units 1 and 2 takes place preferably statically via in each case a proportional element 302, 303 with the proportional gain P=1.

The length l, the moduli of elasticity E and the web speed v can preferably be used for automatic adaptation of the parameters of the dynamic elements, in particular of the time constants.

The disclosure is suitable, in particular, for web-tensioning regulation in machines which, on account of specific given conditions, have a non-adjustable clamping location. Using the example of FIG. 2, this would be the printing unit 4.

For the purpose of isolating the web-tensioning setting operation in the web-tensioning portion 34 by a change in the angular speed at clamping location 3, both a static precontrol of the clamping locations 1 and 2 and a dynamic precontrol of the clamping location 5 take place. As an option, it is likewise possible for components located upstream of the clamping location 1 (e.g. unwinder and/or infeed unit) to be precontrolled. It is likewise possible for all, or selected, further clamping locations 6 . . . n, and optionally discharge unit and winding-up unit, to be precontrolled.

Due to the shown extended upstream feedforward control it is possible to keep the web tension in each web-tensioning portion 12, 23, 34, 45 constant (especially the web tension in the web-tensioning portion 45), without explicit web-tensioning controllers. It should be noted here that the time constant of the additional dynamic downstream feedforward control (see element 301) should correspond to the dynamic behavior of the corresponding web-tensioning portion (i.e. web-tensioning portion 34, as shown in FIG. 2).

That configuration of the disclosure which is shown makes it possible, in a web-processing machine, for even a web-tensioning portion which is bounded downstream by an non-adjustable clamping location to be regulated in isolation.

It is possible for the actual web tensioning required for regulation to be measured via load cells, calculated on the basis of models and/or observed.

Of course, the figures illustrate only exemplary embodiments of the disclosure. It is also conceivable to have any other embodiment, without departing from the context of this disclosure.

The invention claimed is:

1. A method of setting web tensioning in a processing machine for processing a material web, comprising:

giving a first control command to a first clamping location to set the web tensioning in a first web-tensioning portion, which is bounded upstream by the first clamping location and downstream by a second clamping location; and giving a second control command to feed-forward control at least one clamping location which is located upstream of the first clamping location and at least one clamping location which is located downstream of the second clamping location in dependence on the first control command, wherein the second clamping location is not adjusted in response to the first control command or the second control command.

2. The method as claimed in claim 1, wherein the web tensioning is regulated.

3. The method as claimed in claim 1, wherein the at least one clamping location which is located upstream of the first clamping location is feed-forward controlled statically or dynamically in dependence on the first control command.

4. The method as claimed in claim 3, wherein the dynamic feed-forward control comprises a PT1, PT2, PTn, DT1, DT2, DTn, IT1, ITn and/or dead-time response.

5. The method as claimed in claim 1, wherein the at least one clamping location which is located downstream of the second clamping location is feed-forward controlled dynamically or statically in dependence on the first control command.

6. The method as claimed in claim 5, wherein the time response of the dynamic feed-forward control is carried out in proportion to a material-web length and/or reciprocally in relation to the machine speed.

7. The method as claimed in claim 1, wherein the web tensioning in the web-tensioning portion is determined by measuring elements configured to determine a driving torque of at least one clamping location which bounds the web-tensioning portion and/or by observers.

8. The method as claimed in claim 7, wherein the measuring elements are load cells.

9. The method as claimed in claim 1, wherein the web tensioning in a web-tensioning portion is set based on angular adjustment, rate feedback and/or limitation of a driving torque of at least one clamping location which bounds the web-tensioning portion.

10. The method according to claim 1, wherein all steps of the method are performed with a computer program with program code means when the computer program is run on a computer or a corresponding computing unit.

11. The method according to claim 1, wherein all steps of the method are performed with a computer program product with program code means which are stored in a computer-readable data carrier when the computer program is run on a computer or a corresponding computing unit.

12. The method as claimed in claim 1, wherein the processing machine is a shaftless printing machine.

13. A method of setting web tensioning in a processing machine for processing a material web comprising:

giving a first control command to a first clamping location to set the web tensioning in a first web-tensioning portion, which is bounded upstream by the first clamping location and downstream by a second clamping location; and giving a second control command to feed-forward control at least one clamping location which is located upstream of the first clamping location and at least one clamping location which is located downstream of the second clamping location in dependence on the first control command, wherein the feed-forward control takes place with different amplitudes and/or different time responses.

14. A processing machine for processing a material web, comprising:

a plurality of clamping locations configured to clamp the material web and including at least a first clamping location and a second clamping location located downstream from the first clamping location, the first clamping location and the second clamping location configured to bound a web-tensioning portion of the material web, a computing unit electrically coupled to the plurality of clamping locations and configured to set a web tension in the web-tensioning portion, according to a tensioning method including giving a first control command to control the first clamping location, giving a second control command to feed-forward control at least one clamping location which is located upstream of the first clamping location and at least one clamping location which is located downstream of the second clamping location, and wherein the second control command depends on the first control command, wherein the second clamping location is not given the first control command or the second control command, and wherein the first control command and the second control command are configured to set the web tension in the web-tensioning portion.

15. A method of setting web tensioning in a processing machine for processing a material web, comprising:

giving a first control command to a first clamping location to set the web tensioning in a first web-tensioning portion, which is bounded upstream by the first clamping location and downstream by a second clamping location; and giving a second control command to feed-forward control at least one clamping location which is located upstream of the first clamping location and at least one clamping location which is located downstream of the second clamping location in dependence on the first control command, wherein all the clamping locations arranged either upstream or downstream of the first clamping location and configured as processing devices are feed-forward controlled in dependence on the first control command.

16. The method as claimed in claim 15, wherein all the clamping locations which are arranged upstream of the first clamping location and are configured as processing devices, are feed-forward controlled statically in dependence on the first control command.

17. The method as claimed in claim 15, wherein all the clamping locations which are arranged downstream of the second clamping location and are configured as processing devices, are feed-forward controlled dynamically in dependence on the first control command.

* * * * *